United States Patent [19]

Liston

[11] Patent Number: 4,992,828

[45] Date of Patent: Feb. 12, 1991

[54] DIGITIZER HAVING SELECTED AREA DESIGNATION

[75] Inventor: Christopher B. Liston, Rochester, N.Y.

[73] Assignee: Eastman Kodak Company, Rochester, N.Y.

[21] Appl. No.: 448,398

[22] Filed: Dec. 11, 1989

[51] Int. Cl.[5] ..... G03G 21/00

[52] U.S. Cl. ..... 355/202; 355/218; 355/326; 355/328

[58] Field of Search ..... 355/218, 328, 202, 271, 355/71, 200, 326, 327, 210

[56] References Cited

U.S. PATENT DOCUMENTS

| | | | |
|---|---|---|---|
| 4,268,164 | 5/1981 | Yajima et al. | 355/202 X |
| 4,371,898 | 2/1983 | Nakamura | 355/202 X |
| 4,375,918 | 3/1983 | Isono et al. | 355/71 X |
| 4,687,317 | 8/1987 | Appel et al. | 355/218 |
| 4,699,498 | 10/1987 | Naemura et al. | 355/271 X |
| 4,720,729 | 1/1988 | Watanabe | 355/218 |
| 4,734,789 | 3/1988 | Smith et al. | 358/300 |
| 4,742,373 | 5/1988 | Nakatani | 355/202 |
| 4,745,433 | 5/1988 | Fujimura et al. | 355/71 X |
| 4,752,806 | 6/1988 | Haas et al. | 355/202 |
| 4,873,552 | 10/1989 | Otsuki | 355/271 |

FOREIGN PATENT DOCUMENTS

| | | | |
|---|---|---|---|
| 60-206553 | 9/1875 | Japan . | |
| 0291675 | 12/1987 | Japan | 355/328 |

*Primary Examiner*—A. T. Grimley
*Assistant Examiner*—Thu A. Dang
*Attorney, Agent, or Firm*—Milton S. Sales

[57] ABSTRACT

Apparatus for selecting and displaying areas on an original document which are to receive special editing. High intensity light passing through a liquid crystal device (LCD) is projected through the document to highlight the selected areas. Control of the electronic shutters in the LCD is responsive to the coordinate data entered by the digitizing apparatus. The complete area can be highlighted as well as only highlighting a border around the designated area. Specific color can be used for highlighting the selected area to provide additional information as to the type of editing to be performed within the selected area.

20 Claims, 2 Drawing Sheets

DIGITIZER HAVING SELECTED AREA DESIGNATION

BACKGROUND OF THE INVENTION

1. Field of the Invention

This invention relates, in general, to photocopying and, more specifically, to digitizing apparatus used to designate special editing areas on an original document.

2. Description of the Prior Art

Digitizer tablets and like devices can be used to locate points on a hard copy original document and send the coordinates of the points to image processing circuits or apparatus. Such digitizers can be used in connection with computers, work stations, design systems (CAD), and similar apparatus, Digitizers are also useful in connection with copy machines to designate specific areas on the original document which are to receive special treatment or editing. A typical editing function includes doing something different to the designated area, such as erasing, coloring, changing font type, selective processing, inserting image or text information, and moving, rotating, enlarging, or reducing the image. Whatever the purpose of the editing, it is normally desired to designate a two-dimensional area on the original document within which the editing is to occur, and to also select the type of editing.

A wide range of digitizing systems can be found in the prior art. One of the best measures of determining the usefulness of a digitizer is to judge it on its ease of use by an operator. One of the most easily used digitizer systems uses the natural concept of pointing to a few points on the document to designate the area. The position of the pointer is determined to produce the point coordinates. Position located can be accomplished by several techniques, such as sonic triangulation, resistance measurements, and capacitance measurements. By locating two or more points, an area on the original can be defined and enetered as data into the controller.

One difficulty with such systems is the fact that the points used to select the area are not visible on the original in many digitizers. This can cause some ambiguity as to exactly where the area was designated, especially when several areas are selected before the final result of the editing is produced. Since areas rather than points are almost always need in editing, the point method of location can leave some guesswork for the operator as to the precise location and shape of the selected area. While there are some systems which can display the designated points on the document, most systems leave the view of the document unaltered or superimpose the area selected upon a display of the original document on a display device, such as a CRT monitor.

In addition to selecting the area, the type of editing within the area must be selected. Here again, most systems known in the prior art do not visually indicate on the document or elsewhere the type of editing that has been selected. For example, when a certain area is to be highlighted with a specific color, that fact is not apparent from looking directly at the document during the editing process.

Several U.S. Patents hve been issued which teach digitizers trying to overcome these drawbacks. U.S. Pat. No. 4,734,789, issued on Mar. 29, 1988, discloses a copier with special editing apparatus attached to the copy machine. According to this patent, a liquid crystal display overlays the original document, and the areas selected for editing are indicated on the display. This provides a direct correlation between the selected and displayed areas on the original. However, this type of apparatus requires a large display and the extra inconvenience of placing the display over the original document after it is placed on the platen of the copier.

U.S. Pat. No. 4,702,729, issued on Jan. 19, 1988, discloses another copier which can display some information as to the edited area on the original document. In this copier, a single spot light source (131 in FIG. 15) is used to project through the original document to locate the point where the position indicator is located. The light source is moved by control buttons located on the control panel of the copier. This arrangement does not provide a designation of the area selected. Instead, only the location of the point as it is moved to determine the selected area is represented.

U.S. Pat. No. 4,687,317, issued on Aug. 18, 1987, discloses a document scanner which uses a laser-generated light spot projected through the original document to indicate the coordinates of the area selected for special editing. Although the laser beam can be modulated and deflected appropriately to display a one-dimensional line in addition to a sisngle spot, a two-dimensional area on the original document is not produced by the disclosed apparatus. The beam is moved by depressing buttons on the control panel. A disadvantage of this system is the inherent safety requirements dictated by the possible hazard of using a laser beam projected through the platen. See column 6, lines 16–18 of the patent.

Therefore, in order to have a very user-friendly editing device, it is desirable, and an object of this invention, to provide an editing system wherein the area selection can be made directly by pointing to the original document, the area selected is desisgnated two-dimensionally directly upon the document, and special editing instructions, such as coloring, can be indicated directly upon the original document.

SUMMARY OF THE INVENTION

There is disclosed herein a new and useful digitizing system capable of indicating directly upon the original document the complete tow-dimensional area selected during the digitizing process. Additionally, different colors or patterns may be used to indicate the type or format of the special editing which is to occur within the designated areas.

According to the specific embodiment of the invention disclosed herein, a high intensity light source is used to project white light through a controlled liquid crystal display (LCD). The light coming from the LCD is projected through a lens and mirror system onto the underside of the platen of the digitizer or copy machine. The high intensity light passes through the bottom of the original document and is visible at the top of face-up side of the original document which is used during the digitizing process. The shape and location of the light visible on the top of the original document is determined by the number and location of electronic shutters in the LCD which are opened to pass the white light. These shutters are under the control of the electronic systems in the apparatus which receive the coordinate input data from the digitizing pointer.

The light used to highlight the original document can highlight the entire designated area. Alternatively, the light can be used to indicate only the corners of the designated area. Other embodiments include area designations which form a border around the selected area, and designations which can produce an alphanumeric or symbol identifier as to the type of editing which will occur within the selected area.

In specific applications, an LCD which produces colored light can be used to change the color of the light in the designated area for further indicating the type of editing which is to occur. For example, an area which is selected for reproduction in red or some other color would be highlighted by red light from the LCD, or light of the other color.

The apparatus of this invention provides a convenient and user-friendly system for designating the selected area directly upon the original document and, in addition, provides a means for indicating what type of editing is to occur within the selected area.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
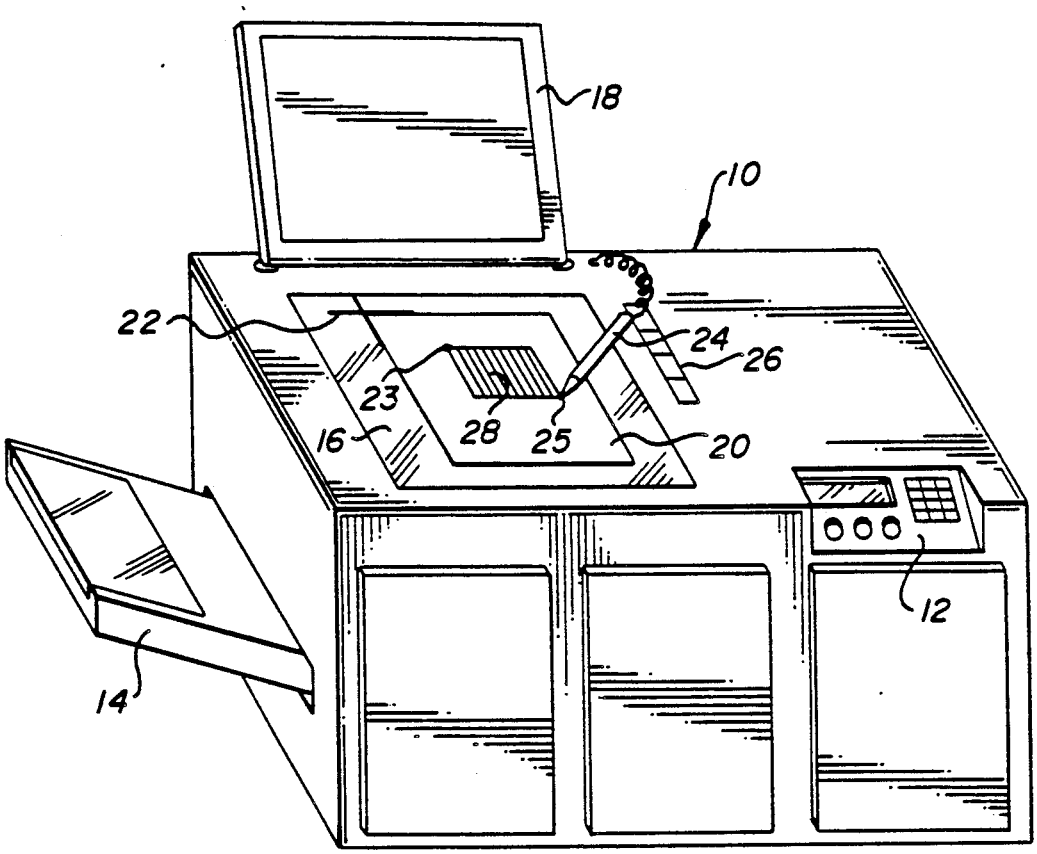
FIG. 1 is a view of a copier equipped with the digitizer of this invention.

Throughout the following description, similar reference characters refer to similar elements or members in all of the figures of the drawings.

Referring now to the drawings, and to FIG. 1 in particular, there is shown a copier 10 which is equipped with the digitizer apparatus of this invention. The copier 10 includes the operator control panel 12, the copy sheet holder 14, the platen 16, and the platen cover 18, which is illustrated in the open position. The original document 20 is placed face-up on the platen 16, as illustrated in FIG. 1 during the editing process. The document 20 is accurately aligned with the registration guide 22 so that points digitized on the document, such as points 23 and 25, can be referenced to a known location. During the digitizing process, the operator moves the pointer 24 to the appropriate locations on the document 20 for the purpose of defining the selected area. Depending upon the type of digitizer, a selected area may be defined by two points, as shown in FIG. 1. Other types of digitizers may require additional points to designate a specific area on the original document. Whatever the number of points required, the pointer 24 is placed on or near to the top surface of the document at the locations needed to define the desired area, and the coordinates of these points are keyed or inserted into the database of the apparatus.

The panel 26 can be used with the pointer 24 to indicate the specific type of editing to occur within the designated area 28. For example, if the designated area is to be of a certain color, specific buttons or areas on the panel 26 can be activated in connection with the area designation so that the apparatus knows that the designated area is to be of a specific color. Various other types of special editing can be used with the system of this invention, including erasing, changing font type, inserting or removing text informaiton, and rotating, enlarging, or reducing the image within the desisgnated area.

The designated area 28 shown in FIG. 1 is rectangular and has been defined by the two points 23 and 25 located by the pointer 24. Pointer 24 may operate by using any of the various digitizing systems known in the prior art, including sonic triangulation, resistance measurements, and capacitance measurements. Regardless of how the area is designated, the apparatus of this invention displays the area 28 directly on the face-up or image side of the original document 20, as shown in FIG. 1. In other words, once the required number of points have been designated, the area becomes visible directly on the original document. Interactive area designation can also be supported by the apparatus of this invention. For example, the operator first selects one point with the pointer 24 and then drags the pointer 24 across the document. As the pointer moves, the designated area is constantly being changed and the changing area is always highlighted and displayed on the original document.

Figure 2:
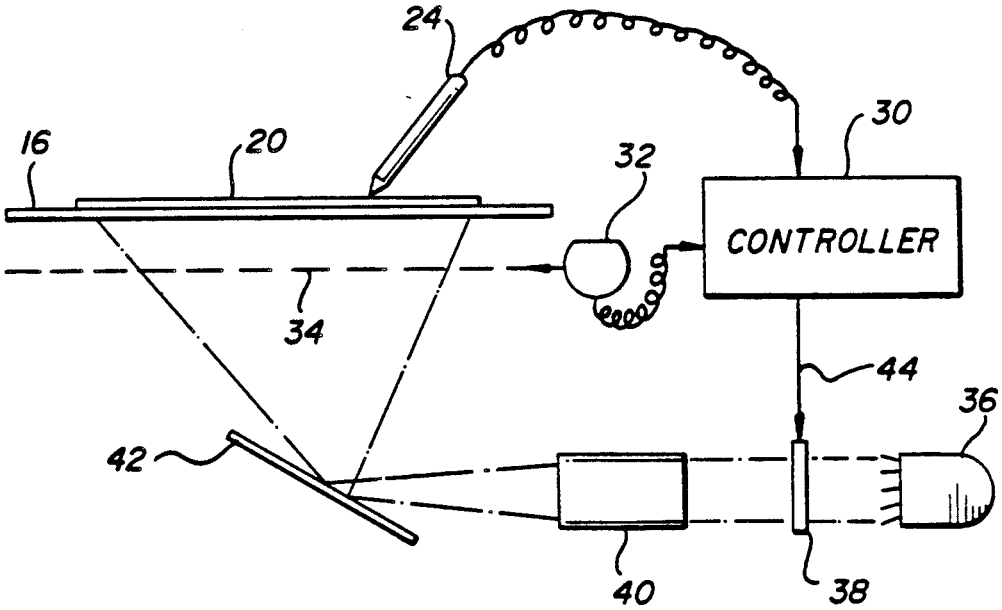
FIG. 2 is a schematic diagram illustrating the digitizer of this invention.

FIG. 2 is a schematic diagram of a digitizer constructed according to this invention which can display designated areas on the top of face-up portion of the original document. According to FIG. 2, the document 20 is placed face-up on the platen 16 and the points defining the selected area are located by the pointer 24 which may be manually moved by the operator or user. The coordinates located by the pointer 24 are fed into the controller 30. The controller 30 stores the area designation data and can also be used to coordinate other functions of the copy machine. In this specific example or embodiment of the invention, the controller 30 also receives data from an optical scanning head 32 which scans across path 34 underneath document 20 to acquire the image information on the original document. Of course, the original document must be placed face-down upon the platen 16 before the image information can be scanned and accepted by the controller 30.

The scanning apparatus of this invention also includes a high intensity, white light source 36, a liquid crystal display or device (LCD) 38, a lens system 40, and a mirror 42. The white light generated by the source 36 passes through the LCD 38 and is projected by the lens system 40 and the mirror 42 upon the underneath side of the document 20 after the light passes through the transparent platen 16. Because of the intensity of the light, a significant portion of the light is visible on the top side of the original doucment 20 and is visible to the observer as a highlighted area on the original document. The specific shape, size, and location of the highlighted area is dependent upon the signal 44 controlling the LCD 38. While different controlling signals are available from the controller 30, it is the relationship between the control signal 44 and the coordinates selected by the pointer 24 which determines the location of the highlighted area on the original document. In other words, the data in the controller 30 not only indicates the location and size of the selected or designated area, it also controls the electronic light shutters in the LCD 38 to highlight a specific area on the document 20 to assist the operator in visualizing the location and shape of the designated area. Although other arrangements may be used, the arrangement using the mirror 42 shown in FIG. 2 is considered desirable because the use of the mirror 42 reduces the overall size of the apparatus. Different tilt angles for the mirror 42 can change the system height. Any non-linearity caused by the mirror angle can be compensated for by the shutter electronics.

Before the area is designated, the individual shutters of the LCD 38 are all opaque. When an area is selected on the digitizer, the control electronics open the shutters which correspond to the selected area. A diffusing platen may be used to produce a diffused glow underneath the original. This technique would be especially desirable when the original document is a transparency.

Figure 3:
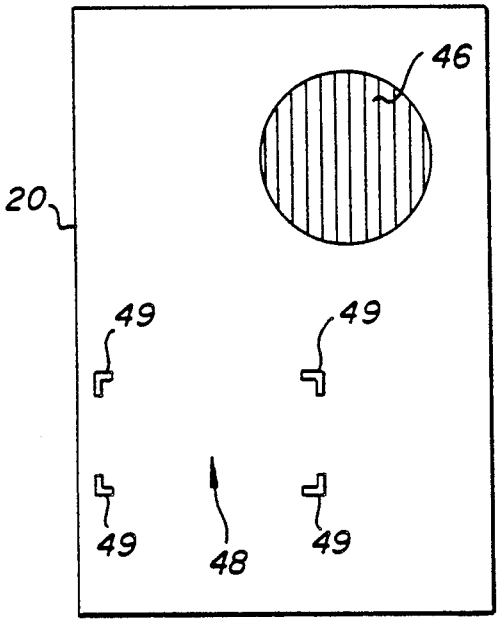
FIG. 3 illustrates two forms of area designation according to the invention.

FIG. 3 illustrates two forms of area designation which may be used according to this invention. Area 46 on document 20 is a completely filled two-dimensional area which provides highlighting of the complete area designated by the operator during the digitizing process. The specific area 46 shown in FIG. 3 is circular. Other shapes may be used within the contemplation of the invention. The significance of the area 46 is that the high intensity light is allowed to pass through the LCD and illuminate the entire area with the designating light. Area 48 shown in FIG. 3 is another form which may be used to highlight or designate the selected area. Area 48 simply illustrates the corners 49 of the selected area. It is assumed by the operator that all of the area bounded by the four corners is included in the designated area. Of course, more than four corners may be used to define the designated area, when the area is a more complicated geometric shape.

Figure 4:
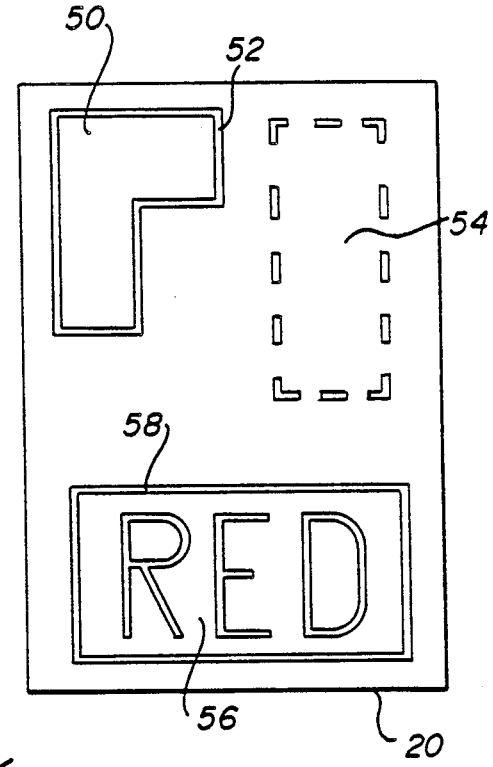
FIG. 4 illustrates three additional forms of area designation according to the invention.

FIG. 4 illustrates three other methods which may be used to designate the selected areas on the original document 20. Area 50 is designated by a border around the complete area. In other words, the border 52 is created by projecting narrow borders of light through the document 20. With this type of area designation, the surface of the document 20 is not highlighted by light passing through the document within the designated area 50 or outside the designated area. Light is visible only at the borders or edges of the designated area. In a similar fashion, the area 54 illustrates a dashed border around the designated area. In either case, the electronic shutters of the LCD are appropriately controlled by the system controller to produce the desired light patterns.

Area 56 shown in FIG. 4 is defined by the border 58 and the word "RED" is displayed within the designated area. This type of highlighting or designation can be used when the type of editing is to be displayed within the designated area. In a similar fashion, the word "ERASE" could be displayed as well as other words to indicate other forms of special editing to occur within the designated area. All of this gives the operator or user useful information as to the location and the type of editing being performed so that the final product will more likely represent the desired edited copy than would be possible without such direct representation of the editing process.

The designated areas highlighted on the original document, as shown in FIGS, 3 and 4, and other ways for designating the areas not shown in these figures but contemplated by the invention, can be produced in white light from the light source. It may also be desirable to use light which is colored to represent some information about the editing which is to be done within the area. Colored light may be used to indicate specific types of editing, or in the case of color editing, the actual color to be used within the designated area may be used for the highlighting of the selected area on the document. For example, if the area 46 in FIG. 3 is to be produced in blue color, blue light can be used to highlight the entire area 46.

Figure 5:
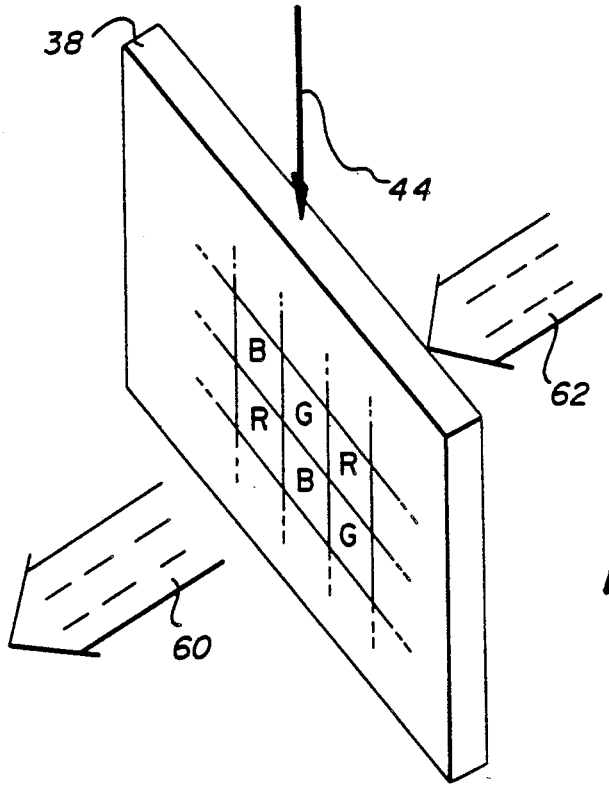
FIG. 5 is a view of an LCD shutter which can be used to produce area designations in color.

FIG. 5 illustrates an LCD 38 which may be used to produce different colors and patterns of light for highlighting designated areas on the original document. According to FIG. 5, the separate electronic shutters of the LCD 38 are covered with filters of the three primary colors, red, green, and blue. Although only a portion of the number of shutters in the LCD 38 are illustrated in FIG. 5, and these are illustrated enlarged for clarity, it is contemplated that all of the shsutter elements in the LCD would have a color filter associated therewith. Consequently, by controlling the specific electronic shutters within the LCD, particular colors can be produced in the output light 60 from the original white light source 62. Of course, areas not to be highlighted would be blocked from passing light in this color embodiment of the invention and also in the other embodiments of the invention where colored light is not to be produced.

The apparatus of this invention provides a convenient method for highlighting areas on an original document which are to edited by special techniques. In addition to designating the area to be edited, information about the content or function of the editing can also be displayed. It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. Apparatus for designating and area on a top side of an original document which is to receive special editing, said apparatus comprising:

means for selecting an area, including size and location of the area, on the top side of the original document which is to be edited;

means for producing a two-dimensional light image which is shaped to distinguish the selected area; and means for projecting said two-dimensional light image through the original document from a bottom side to the top side to make the selected area distinguishable from other areas on the original document.

2. The apparatus of claim 1 wherein the image producing means includes a high intensity light source and an electronic light shutter device positioned between the light source and the bottom side of the original document.

3. The apparatus of claim 2 wherein the light shutter is a liquid crystal device (LCD).

4. The apparatus of claim 1 wherein the area to be edited is selected by using a digitizing pointer on the top side of the original document.

5. The apparatus of claim 1 wherein the light image producing means is located inside an enclosure of a copy machine and the document is located face-up on a transparent platen of the copy machine during designation.

6. The apparatus of claim 1 wherein the two-dimensional light image is produced in color.

7. The apparatus of claim 6 wherein the color of the produced light image is responsive to a color selected.

8. The apparatus of claim 7 wherein the color of the produced light image is similar to the color selected.

9. the apparatus of claim 6 wherein the image producing means includes a high intensity, white light source and a liquid crystal device (LCD) positioned between the light source and the bottom side of the original document, said LCD having an ability to filter a white light and produce a colored light image.

10. The apparatus of claim 1 wherein the two-dimensional light image which distinguishes the areas illuminates all of the area designated.

11. The apparatus of claim 1 wherein the two-dimensional light image which distinguishes the areas forms a border outline around all of the area designated.

12. The apparatus of claim 1 wherein the two-dimensional light image which distinguishes the areas only indicates corners of the area designated.

13. The apparatus of claim 1 wherein the two-dimensional light image which distinguishes the areas includes a word defining a color selected for use in the designated area, said word being displayed within the designated area.

14. Apparatus for designating an area on a top side of an original document which is to receive special editing, said apparatus comprising:

a digitizing pointer;

means for coordinating a position of the digitizing pointer when it is placed on or near to the top side of the original document for selecting the area for special editing;

a light-transmitting support member on which the original document is placed face-up during designation;

a light source effectively located underneath the support member;

a two-dimensional electronic light shutter optically positioned between the light source and the support member;

means for controlling a pattern of light passing through the electronic light shutter to form a light image which is two-dimensionally shaped similar to the area designated; and means for projecting said light image through the support member and through the original document from a bottom side to the top side to make the selected area distinguishable from other areas on the original document.

15. The apparatus of claim 14 wherein the light source produces white light.

16. The apparatus of claim 14 wherein the electronic light shutter is a liquid crystal device (LCD).

17. The apparatus of claim 16 wherein the distinguishing light image illuminates all of the area designated.

18. The apparatus of claim 16 wherein the LCD is capable of producing light images in different colors.

19. Apparatus for designating an area on a top side of an original document which is to receive a special color, said apparatus comprising:

a digitizing pointer;

means for coordinating a position of the digitizing pointer when it is placed on or near to the top side of the original document for the purpose of selecting the area for the special color;

a light-transmitting support member on which the original document is placed face-up during designation;

a white light source effectively located underneath the support member;

a two-dimensional liquid crystal device (LCD) optically positioned between the light source and the support member, said LCD being capable of producing light images in different colors;

means for controlling a pattern of light passing through the LCD to form a colored light image which is two-dimensionally shaped similar to the area designated, with said colored light image being similar to a color selected; and means for projecting said colored light image through the support member and through the original document from a bottom side to the top side to make selected area distinguishable from other areas on the original document.

20. The apparatus of claim 19 wherein the colored light image which distinguishes the areas illuminates all of the area designated on the original document in a color of light selected for that area.

* * * * *

UNITED STATES PATENT OFFICE

CERTIFICATE OF CORRECTION

Patent No. 4,992,828 Dated February 12, 1991

Inventor(s) Christopher B. Liston

It is certified that error appears in the above-identified patent and that said Letters Patent is hereby corrected as shown below:

| Column and Line In Printed Patent | Mistake Noted |
| --- | --- |
| Col. 6, line 34<br>Claim 1 | After "designating" change "and" to -- an--. |

Signed and Sealed this

Tenth Day of March, 1992

*Attest:*

HARRY F. MANBECK, JR.

*Attesting Officer*

*Commissioner of Patents and Trademarks*

UNITED STATES PATENT OFFICE

CERTIFICATE OF CORRECTION

Patent No. 4,992,828 Dated February 12, 1991

Inventor(s) Christopher B. Liston

It is certified that error appears in the above-identified patent and that said Letters Patent is hereby corrected as shown below:

| Column and Line In Printed Patent | |
|---|---|
| Col. 6, line 34<br>Claim 1 | After "designating" change "and" to -- an--. |
| Col. 8, line 18<br>Claim 19 | After "for" delete --the purpose of--. |
| Col. 8, line 37<br>Claim 19 | After "make" insert --the--. |

This Certificate supersedes Certificate of Correction issued March 10, 1992.

Signed and Sealed this

Tenth Day of November, 1992

*Attest:*

DOUGLAS B. COMER

*Attesting Officer*

*Acting Commissioner of Patents and Trademarks*